US005967031A

United States Patent [19]

Gauss

[11] Patent Number: 5,967,031

[45] Date of Patent: Oct. 19, 1999

[54] STENCIL SET AND METHOD OF APPLYING STENCILED DESIGNS

[75] Inventor: Jane Gauss, Hudson, Ohio

[73] Assignee: Plaid Enterprises, Inc., Norcross, Ga.

[21] Appl. No.: 08/700,551

[22] Filed: Jul. 16, 1996

[51] Int. Cl.[6] ..... B41M 1/14; B41F 15/04

[52] U.S. Cl. ..... 101/129; 101/115

[58] Field of Search ..... 101/129, 115

[56] References Cited

U.S. PATENT DOCUMENTS

| | | | |
|---|---|---|---|
| 799,609 | 9/1905 | Ludwig | 434/102 |
| 2,293,696 | 8/1942 | Burchell | 41/34 |
| 2,444,860 | 7/1948 | Summer | 101/115 |
| 2,891,323 | 6/1959 | Eckstein et al. | 35/28.3 |
| 3,011,433 | 12/1961 | Coakley | 101/115 |
| 3,855,924 | 12/1974 | Morse, Jr. | 101/129 |
| 4,125,658 | 11/1978 | Miles | 101/127 |
| 4,634,616 | 1/1987 | Musante et al. | 428/40 |
| 5,372,506 | 12/1994 | Hambright | 101/129 |

FOREIGN PATENT DOCUMENTS

| | | | |
|---|---|---|---|
| 19181/29 | 3/1929 | Australia | 101/129 |

*Primary Examiner*—John S. Hilten
*Assistant Examiner*—Amanda B. Sandusky
*Attorney, Agent, or Firm*—Isaf, Vaughan & Kerr; Louis T. Isaf

[57] ABSTRACT

An improved stencil set and method of applying stenciled designs to a surface is provided. A plurality of stencil sheets are provided wherein each stencil sheet has a distinct portion of the design represented by cutout areas in the sheet and remaining portions of the design visibly printed on the sheet. The sheets are used in sequence to apply the design to a surface and, in the preferred embodiment, with each sheet, the portions of the design not being immediately applied to the surface are visible to the user on the stencil sheet itself.

4 Claims, 1 Drawing Sheet

STENCIL SET AND METHOD OF APPLYING STENCILED DESIGNS

TECHNICAL FIELD

The present invention relates generally to home decorating and more specifically to the application of stenciled designs to surfaces, such as walls.

BACKGROUND OF THE INVENTION

For many years, homeowners and others have decorated their homes by applying stenciled designs to the walls. Usually, such designs are applied around the crown of a room where the walls of the room meet the ceiling. However, stenciled designs can and are applied to other portions of the walls and, indeed, to other surfaces in the home as well.

Stenciled designs typically are applied to a surface using one or more stencils made of paperboard or plastic. These stencils are formed with cutout areas that correspond to various portions of the design to be created. In applying the design, the stencil or stencils usually are taped or otherwise secured to the surface where the stenciled design is to be applied. Paint can then be applied through the cutout areas of the stencil onto the surface. Commonly, the paint is applied through the cutout areas with a brush or a sponge. However, paint is sometimes applied by different means such as, for example, by spraying the paint through the cutout areas or by rolling the paint over the stencil and through the cutout areas. In any event, the paint is applied to the surface through the cutout areas of a stencil, whereupon the stencil is removed leaving the resulting design on the surface.

In some instances, the entire design to be applied is represented by cutout areas in a single stencil. When using these stencils, paint of one color is applied through designated cutout areas corresponding to that color. The stencil is then washed, removed, or cleaned, and reattached to the surface so that paint of another color can be applied through other ones of the cutout areas in the stencil. This process is repeated with the various colors of the design until the completed multi-color design has been applied to the surface through all of the cutout areas in the stencils. As a guide to mixing and matching colors and applying them through the appropriate cutout areas, such stencils are usually provided with a printed facsimile of how the stenciled design should look when applied to the surface. As the design is being applied, constant reference back to the printed facsimile is made in order to gauge and judge the proper color mixes and positions for creating the completed design.

While the foregoing method has been used successfully for many years in applying stenciled designs to surfaces, it nevertheless embodies certain inherent problems and shortcomings. For example, the process of applying a particular color only through certain ones of the cutout areas can be tedious and the user must be careful to apply a particular color through only the proper corresponding cutout areas. In many instances, mistakes can be made in this regard affecting the final appearance of the stenciled design. An additional problem with such stencils resides in the fact that a user must refer constantly to a printed facsimile of the finished design as the design is applied in order to judge the appropriate hues, balances, and mixes of colors. This can make color balancing difficult since the characteristics of an applied color must be visually estimated by reference to a separate printed facsimile. Finally, it is not always a simple matter with such stencils to align the stencil precisely from color application to color application and resulting misalignment can affect the look and quality of the finished design.

Even when multiple stencils are used to apply the design, many of the problems with single stencil applications still exist. While the use of multiple stencils addresses some of the problems of cleaning the stencil between each application, the colors applied with each stencil still must be estimated by visual reference to a printed facsimile of the final design. Alignment of the successive stencils in the set can also be a problem and the appearance of the final design is highly dependent upon the skill of the user in interpreting and matching the colors, hues, intensities and tints as they are displayed on the printed facsimile.

A general consequence of the use of prior art stenciling methods has been that skillful application of stenciled designs comes only after substantial experience in applying the designs. It has been difficult in the past for a novice or unexperienced person to apply the designs with the same quality results as an experienced application. For this reason, some who consider themselves insufficiently skilled have hired professionals at substantial cost to apply their stenciled designs.

Attempts have been made to address some of the problems associated with prior art stenciling methods. For example, U.S. Pat. No. 2,444,860 of H. Summer attempts to address the alignment and registration problems associated with multiple stencil sets by providing a holder for each of the sequential stencils in the set. Each stencil is aligned precisely in the holder and the holder can be taped or otherwise secured to the wall so that the elements of the final design are properly aligned. While the H. Summer device indeed helps in aligning various stencils of a stencil set, it nevertheless does not resolve the problems associated with judging the qualities and characteristics of each color from a separate printed facsimile of the final design. Thus, substantial skill and experience is still required to produce a high quality design.

Accordingly, there exists a need for an improved stenciling method and apparatus that addresses the problems and shortcomings of the prior art.

SUMMARY OF THE INVENTION

The present invention, in a preferred embodiment thereof comprises an improved stencil set and related method for applying a stenciled design to a surface. The stencil set of the present invention includes a plurality (i.e., two or more) of stencil sheets, preferably made of substantially transparent plastic, wherein each stencil sheet has a distinct portion of the design represented by cutout areas in the sheet and remaining portions of the design visibly printed on the sheet. The sheets are used in sequence to apply the design to a surface and, in the preferred embodiment, with each sheet, the portions of the design not being immediately applied to the surface are visible to the user on the stencil sheet itself. A first stencil sheet is for application of a first portion of the design to the surface and has cutout portions corresponding to the first portion of the design. Similarly, a second stencil sheet is for application of a second portion of the design to the surface and has cutout areas corresponding to the second portion of the design. In embodiments of the invention having more than two stencil sheets, each subsequent stencil sheet is for application of a different, other portion (e.g., third portion, fourth portion, etc.) of the design to the surface and has cut out areas corresponding to the respective, other portion of the design.

In a two stencil embodiment, in addition to the cutout areas corresponding to the first portion of the design, the first stencil sheet also has the second portion of the design printed thereon adjacent to the cutout areas corresponding to the first portion of the design. The printed second portion on the first stencil sheet is colored, shaded, and tinted to match a desired final look of the second portion of the second portion of the stenciled design on the surface. Similarly, the second stencil sheet has the first portion of the design printed thereon adjacent to the cutout areas corresponding to the second portion of the design. Thus, each of the stencil sheets includes both portions of the design with its respective portion represented by cutout areas and with remaining portions printed in color rendition on the stencil sheet itself. In embodiments of three or more stencils, in addition to the cut out areas, each stencil sheet includes a printed portion on which is printed, directly to the stencil sheet in proper design relationship to the cut out area of the respective stencil, portions of the design which correspond to cut out areas on other of the stencil sheets in the set. Depending on the complexity of the design and number of stencils, the printed portion of one stencil will include all or some of the portions of the design corresponding to the cut out areas of some or all of the other stencil sheets in the set. In any event, in the preferred embodiments, the printed portion of each stencil sheet includes, printed on the respective sheet, all of the remaining portions of the final design which remaining portions do not fall within a cut out area of the respective stencil sheet.

Preferably, a registration guide is also printed on each of the stencil sheets so that the sheets can easily be overlaid and aligned with one another. When so aligned, the printed portions of the first sheet are visible through the cutout portions of the second sheet and vise-versa. Thus, when the sheets are overlaid and aligned, the entire design to be applied with the stencils can be viewed and studied by observing the overlaid stencil sheets themselves and the various color hues, tints, and the like can be seen together.

With reference to a stencil set embodiment having two stencil sheets, in using the stencil set of the present invention, the first stencil sheet is taped or otherwise secured to the surface where the design is to be applied. Paint or other pigment can then be applied with a brush, sponge, or other applicator through the cutout portions of the first sheet, which correspond to a first portion of the design. As the paint is applied, its various characteristics such as tint, hue, intensity, and the like, can easily be judged relative to other portions of the design because the other portions are printed on the stencil sheet itself. Therefore, there is no need to refer to a separate printed facsimile of the final design constantly as the pigment is being applied. For further reference, the second stencil sheet can be placed atop the first and registered therewith using the registration guide. Since the sheets preferably are transparent, the cutout areas of the first sheet will align with the printed areas of the second and vise-versa. Thus, a complete image of the design is visible on the surface itself. This provides a much more accurate reference for the characteristics of the paint to be applied.

Once the first portion of the design is applied through the cutout areas of the first stenciled sheet, this stencil sheet is removed and replaced by the second stencil sheet. The design on the second stencil sheet is aligned with the previously applied design by aligning the previously applied first portion of the design with that portion as printed on the second stencil sheet. In this way, near perfect alignment is easily achieved. The second portion of the design can then be applied through the cutout areas of the second stencil sheet. As with the first stencil sheet, matching and balancing colors is simple since the first portion of the design is visible right on the surface adjacent to the second portion being applied. Again, no reference to a separate printed facsimile is necessary as with prior art methods.

Thus, it is seen that an improved stencil set and method of stenciling is now provided wherein stenciled designs can be applied to a surface without constantly referencing a separate printed facsimile of the finished design. Instead, the entire design is visible on the stencil sheets themselves and thus right on the surface as the design is being applied. The result is a much more professional finished design, even when applied by novices. In addition, the successive stenciled sheets of the set can easily be aligned with previously applied portions of the design simply by aligning printed portions of the design on the sheet with the corresponding portions previously applied to the wall. Finally, if the entire design needs to be studied in advance, the various stenciled sheets of the set can be registered with the aid of registration marks printed on the sheets and viewed to the light. When so aligned, the printed portions of one sheet align with and show through the cutout portions of the other sheet permitting a user to view the entire design as it should appear when completely applied to the wall. The stencil set of this invention minimizes, and in some cases eliminates, the need to provide separate printed color facsimiles of the final design along with the stencil kit. These and other objects, features, and advantages will become more apparent upon review of the detailed description set forth below when taken in conjunction with the accompanied drawings, which are briefly described as follows.

DETAILED DESCRIPTION OF THE PREFERRED EMBODIMENT

Figure 1:
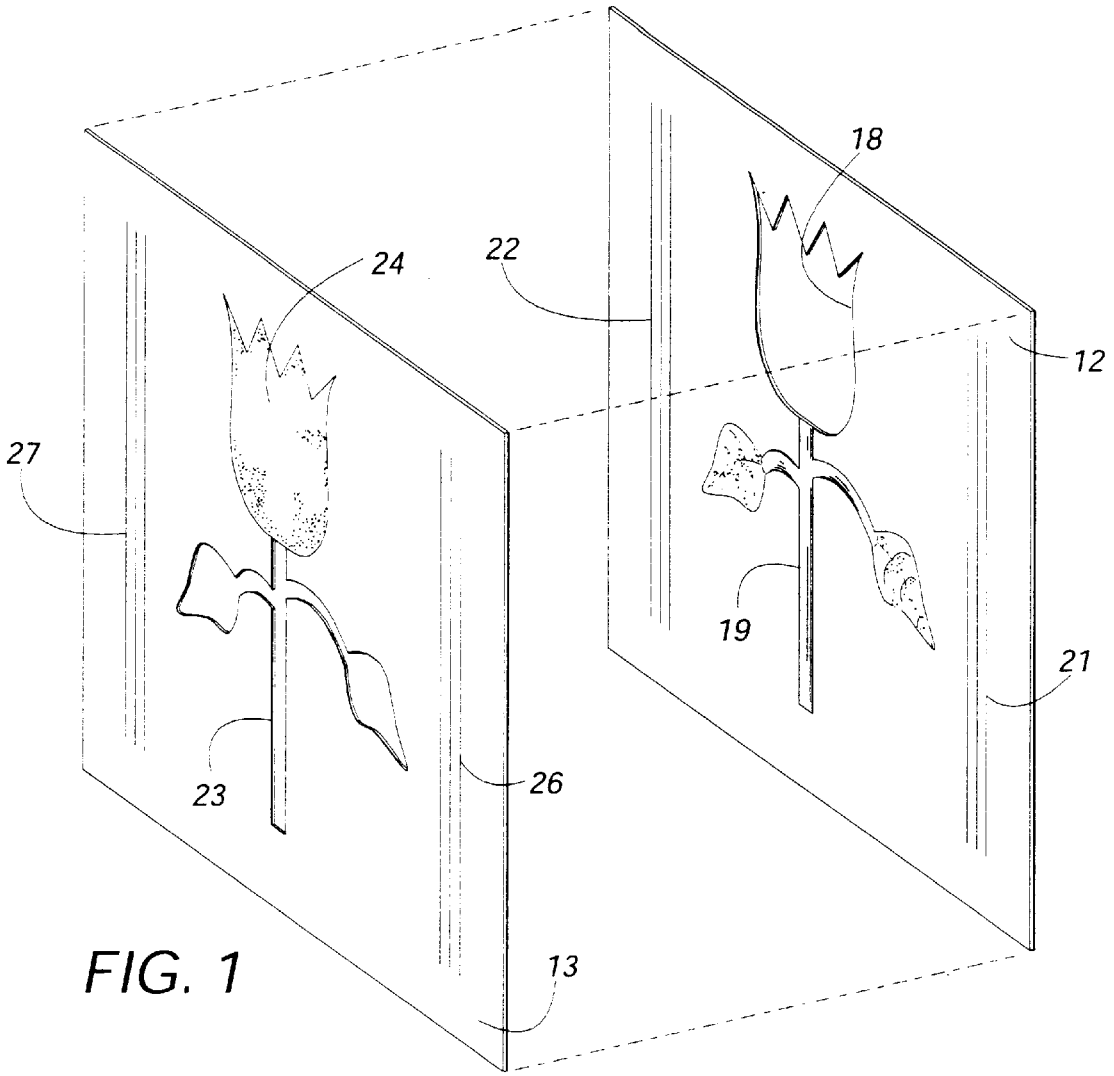
FIG. 1 is a perspective view of a stencil set that embodies principles of the present invention in a preferred form.

Referring now in more detail to the drawing figures, FIG. 1 is a perspective view of a stencil set that illustrates the present invention in a preferred embodiment. The stencil set 11 comprises a first stencil sheet 12 and a second stencil sheet 13. The stencil sheets 12 and 13 preferably are made of thin, substantially transparent plastic sheet material that is light, inexpensive, and durable. However, the stencil sheets 12 and 13 could be formed of any substantially transparent material. Further, while two stencil sheets are illustrated in FIG. 1 for clarity of explanation and description of the invention, it will be understood that the present invention may be embodied in stencil sets of three or more sheets, depending upon the complexity of the finished design to be applied.

Figure 2:
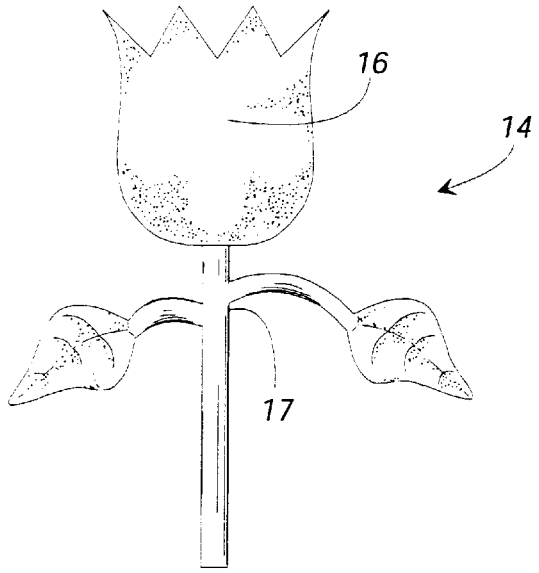
FIG. 2 is an illustration of the final stenciled design as applied with the stencil set of the preferred embodiment.

The stencil set 11 shown in FIG. 1 is designed for the application of the simple tulip design, shown in FIG. 2, to a surface. The tulip design 14 has two portions; namely, a flower or bulb 16 and a stem and leaves 17. In reality, the bulb 16 might be colored shades of one color, such as, for example, yellow or red, while the stem and leaves 17 may be colored shades and hues of green.

While a simple tulip design made up of two portions have been illustrated in the drawings for clarity of explanation, it will be understood that designs of any desired level of complexity and with any number of different portions can be achieved through application of the present invention. For example, a cluster of roses might be applied with five different portions of the design to be colored five different colors. Such a complex design could be applied easily with the present invention with five stencil sheets, each having cutout areas corresponding to a different portion of the design. Accordingly, the simplicity of the design and the use of two stencil sheets as illustrated in FIGS. 1 and 2 should not be considered a limitation on the complexity or the number of stencil sheets that could be employed using the present invention.

Referring again to FIG. 1, the first stencil sheet 12 has a cutout area 18 that corresponds to the first portion of the design; that is, to the bulb 16 (FIG. 2). The second portion of the design, i.e., the stem and leaves 17, are visibly depicted on the first stencil sheet at 19 and are oriented and positioned with respect to the cutout portion 18 as the stem and leaves are to appear in the final design. The visible depiction 19 can be printed on the first stencil sheet 12 in numerous ways including, but not limited to, silk screening, dot matrix printing, lithography, or other method. Regardless of the method, the visible depiction 19 preferably is colored, shaded, and textured in the same way that the stem and leaves 17 should appear in the finished design when it is applied to the surface. Registration lines 21 and 22 are printed on the first stencil sheet 12 on the right and left hand side thereof respectively, for purposes of aligning and registering the designs on the two sheets as described in more detail below.

The second stencil sheet 13 has a cutout area 23 that corresponds to the second portion of the design 14, i.e., to the stem and leaves 17. The first portion of the design, i.e., the bulb 16, is visibly depicted on the second stencil sheet 13 at 24. The visible depiction 24 is printed on the second stencil sheet 13 and is colored and shaded to match the desired final appearance of the bulb 16 when the design is applied to the surface.

The second stencil sheet 13 has registration lines 26 and 27 on its right and left hand sides respectively. The registration lines 26 and 27 are positioned on the second stencil sheet 13 so that when the second stencil sheet is laid atop the first stencil sheet and the lines 26 and 27 are registered with lines 21 and 22, then the visibly depicted portions of the image on each sheet align with and show through the corresponding cutout portion on the other sheet. Thus, when the two sheets are overlaid and registered, a complete image of the finished design as it should look when applied to the surface is presented. Thus, the need for a separate printed depiction of the finished design is minimized and, in some cases, eliminated since the design can be created by overlaying the sheets and looking through them.

When using the present invention to apply a stencil design to a surface, the user first tapes or otherwise affixes the first stencil sheet 12 to the surface where the design is to be applied. The second stencil sheet can then be positioned over and registered with the first sheet if desired so that a complete image of the design can be viewed against the surface. The color to be applied with the first stencil sheet is, thus, ascertained. The second sheet is then removed and paint or other pigment is applied through the cutout areas of the first stencil sheet onto the surface to apply the first portion of the design to the surface. Alternately, the stencil sheets of some embodiments are labeled (for example, A, B, C, D, etc.) and a color key is provided, for example, with an instruction sheet which instructs to "apply color red with stencil sheet A", "apply color green stencil sheet B", etc. As the paint is applied, the user can easily judge the relationship between the paint being applied and the color of the other portions of the design to be applied later because these portions are visibly depicted on the stencil itself. Thus, color, hue, and texture matching can easily be accomplished as the paint is being applied without referring to a separate printed facsimile. If, at any time, the user needs a guide in this regard, the second stencil sheet can be positioned over the first so that the color scheme to be applied through the cutout area of the first is shown by the visibly depicted area on the second sheet.

When the first portion of the design is applied through the cutout area 18 of the first stencil sheet 12, this sheet is removed from the surface and can, if desired, be cleaned. The second stencil sheet 13 is then taped or otherwise affixed to the surface overlying the previously applied first portion of the design. In order to align the second stencil sheet 13 with the applied first portion, the user need only line up the visibly depicted portion 24 with the first portion of the design that was previously applied to the surface. Upon such alignment, the second portion of the design corresponding to the cutout portion 23 in the second stencil sheet is properly aligned and oriented with respect to the previously applied first portion. Paint is then applied through the cutout portion 23 in the second stencil sheet to complete the stenciled design on the surface. As with the first sheet, the user is guided in applying paint by the visible depiction of the first portion of the design on the second stencil sheet itself as well as by the portion showing through the sheet from the surface. Again, as a guide, the user can place the first sheet 12 over the second sheet 13 and align them using the registration lines to provide a further guide as to the desired color characteristics to be applied through the cutout portion 23.

When the second portion of the design is applied through the cutout portion 23, the second stencil sheet 13 is removed from the surface revealing the completed design as applied to the surface through the two stencil sheets. The user then may, if desired, repeat the process at an adjacent position on the surface to create a repeating design around a room.

The stencil set and the method of this invention has been found to be superior to prior art methods of stenciling because, in part, the need to judge color characteristics of a color being immediately applied relative to colors of the design not being immediately applied by referring to a separate printed facsimile of the final design is eliminated. Instead, the portions of the final design not being immediately applied are always visible to the user right on each stencil as the design is being applied. The result is a completed design wherein the elements are properly aligned with respect to each other and display color combinations that are true and accurate. The present invention is found to be useful and helpful to novices and those with little experience in applying stenciled designs.

The invention has been described in terms of preferred embodiments and methodologies. It will be obvious to those of skill in this art, however, that various modifications or extensions may be made to the illustrated embodiments. As mentioned above, for example, three, four, or even more stencil sheets could be used to create complex designs having many portions of different colors. Furthermore, it should be noted that, although the present invention has as an object, in its preferred embodiments, the ability to minimize and in some cases avoid the need to include a separate printed facsimile of the final design, the invention can be used in conjunction with such a separate printed facsimile and, in some embodiments of the invention, such a facsimile is desired.

While the embodiments of the present invention which have been disclosed herein are the preferred forms, other embodiments of the apparatus and methods of the present invention will suggest themselves to persons skilled in the art in view of this disclosure. Therefore, it will be understood that variations and modifications can be effected within the spirit and scope of the invention and that the scope of the present invention should only be limited by the claims below.

I claim:

1. A stencil set for applying a stenciled design to a surface, each stencil sheet having a corresponding portion of the design represented by cut out areas of the sheet and remaining portions of the design visibly depicted on the sheet, whereby one portion of the design can be applied to the surface through the cut out areas of one stencil sheet and another stencil sheet can be placed against the surface with the visibly depicted portion of the design thereon registered with the previously applied portion of the design on the surface to align the portions of the design whereupon another portion of the design can be applied to the surface through the cut out areas of the other stencil sheet, said portions on the surface having a desired finished color and said visibly depicted portions of the design on said stencil sheets are colored to correspond to the desired finished color of said portions on the surface to provide a hue and shading guide as portions of the design are applied to the surface through the cut out areas in each of said stencil sheets.

2. A stencil set as claimed in claim 1, and further comprising means for registering said stencil sheets so that the visibly depicted portions of the design on one sheet are visible through the cut out areas of the other sheet to present a completed image of the design for reference.

3. A stencil set as claimed in claim 2, and wherein said means for registering said stencil sheets comprises registration marks printed on said sheets.

4. A stencil set as claimed in claim 3, and wherein said registration marks comprise an array of lines on said sheets.

* * * * *